US005258255A

United States Patent [19]

Shimizu et al.

[11] Patent Number: 5,258,255

[45] Date of Patent: Nov. 2, 1993

[54] ELECTROSTATIC CHARGE IMAGE DEVELOPER COMPOSITION

[75] Inventors: Jun Shimizu; Masayoshi Nawa; Yoshihiro Fukushima, all of Wakayama, Japan

[73] Assignee: Kao Corporation, Tokyo, Japan

[21] Appl. No.: 913,633

[22] Filed: Jul. 16, 1992

[30] Foreign Application Priority Data

Jul. 17, 1991 [JP] Japan ..... 3-203870

[51] Int. Cl.[5] ..... G03G 9/087; G03G 9/093

[52] U.S. Cl. ..... 430/110; 430/111

[58] Field of Search ..... 430/110, 111

[56] References Cited

U.S. PATENT DOCUMENTS 4,051,077 9/1977 Fisher ..... 430/110
4,968,576 11/1990 Maruta et al. ..... 430/111 X
5,037,717 8/1991 Ishii et al. ..... 430/110
5,085,963 2/1992 Suzuki et al. ..... 430/110 X

FOREIGN PATENT DOCUMENTS 186853 9/1985 Japan ..... 430/110
186875 9/1985 Japan ..... 430/111
1-01557 4/1989 Japan ..... 430/110

*Primary Examiner*—Roland Martin
*Attorney, Agent, or Firm*—Birch, Stewart, Kolasch & Birch

[57] ABSTRACT

A developer composition for an electrostatic charge image, which comprises a toner comprising a binder resin and a coloring agent, and 0.1 to 1.0% by weight of fine polymer particles with a glass transition temperature of 90° C. or higher deposited on the surface of the toner, the binder resin comprising, as a main component, a polyester resin with an OHV/AV value of 1.2 or more wherein OHV and AV represent the hydroxyl value and acid value of the polyester resin, respectively.

8 Claims, No Drawings

ELECTROSTATIC CHARGE IMAGE DEVELOPER COMPOSITION

FIELD OF THE INVENTION

This invention relates to a developer composition for developing an electrostatic charge image in electrophotography, electrostatic recording, electrostatic printing, etc.

BACKGROUND OF THE INVENTION

In conventional electrophotographic processes, a light-electroconductive insulating layer is uniformly charged (charging stage), the layer is then exposed to light and charges in the exposed areas are dispersed to form an electrostatic latent image (exposure stage), further charged colored fine particles (toner) are deposited on the electrostatic latent image to thereby convert the latent image to a visible image (development stage), the thus-formed visible image is transferred onto a transfer material such as transfer paper (transfer stage), and the visible image is permanently fixed by an appropriate means such as heating or an application of pressure (fixing stage) as described in U.S. Pat. Nos. 2,221,776, 2,297,691 and 2,357,809. Further, after the toner image is transferred, toner grains left on a photo conductor are removed to clean the surface of the material (cleaning stage).

Toner grains fed to a developing apparatus in the development stage are consumed, and fresh toner grains are generally fed to the developing apparatus from a toner feeding device called a "hopper". To conduct stable development, a metal oxide such as silica can be added to the surface of the toner to impart sufficient fluidity to the toner from the hopper to the developing apparatus and, further, to rapidly charge the toner to a proper charged amount when the toner is stirred in the developing apparatus.

The cleaning of the toner left can be generally made by means of a cleaning blade. However, a load is applied to the cleaning blade during the course of the continuous duplication stage. This results in disadvantages such as reversing or breaking the cleaning blade, and fusing the toner left onto the surface of the photo conductor by the pressure of the cleaning blade or by the frictional heat arising between the surface of the material and the cleaning blade. Further, there is a possibility that the toner grains which cannot be removed by the cleaning blade are accumulated and a failure in cleaning occurs. Accordingly, methods have been proposed wherein cleaning aids such as the metal salts of fatty acids are added to the toner to improve cleaning.

When the metal salts of the fatty acids as the cleaning aid are added to the toner, the reversing of the blade and the filming of the toner on the photo conductor can be prevented. However, this disadvantageously results in the occurrence of filming of the metal salts of the fatty acids, and, particularly, when a binary developer system is used, the metal salts of the fatty acids accumulate in the developer during the course of continuous duplication and the fluidity of the developers is changed.

JP-A-60-186851 (the term "JP-A" as used herein means an "unexamined published Japanese patent application") proposes that fine particles of acrylic polymers such as fine particles of a methyl acrylate-butyl acrylate copolymer are added to the toner to improve cleaning and charging stability. However, this method has problems in that only when fine particles of the acrylic polymers are added to the toner as mentioned above, the agglomeration of fine particles of the acrylic polymers and the adhesion thereof to the photo conductors are increased. As a result, the fluidity of the toner is lowered and filming of fine particles of the acrylic polymers on the photo conductors occurs.

JP-A-1-291258 proposes to add acrylic polymers having a particle size of not larger than 0.05 μm such as fine particles of polymethyl methacrylate. When such fine particles have a particle size of not larger than 0.05 μm, a failure in cleaning can be prevented from occurring. However, frictional resistance to the blade cannot be reduced. Hence, the addition of the fine particles does not have an effect of solving the problems with regard to the reversing and breakage of the cleaning blade.

Binder resins which are conventionally used include polystyrene, styrene copolymers such as styrenebutadiene copolymers and styrene-acrylic copolymers, polyethylene, ethylene copolymers such as ethylene-vinyl acetate copolymers, poly(meth)acrylic esters, polyester resins, epoxy resins and polyamide resins. When toners containing these resins are used, the reversing and breakage of the blade in the cleaning stage occurs although the reasons for these unfavorable occurrences are not known. Accordingly, it has been demanded to develop a developer composition which is effective in preventing the reversing and breakage of the blade from occurring.

When the polyester resins are used as the principal component of the binder resin, polyester resins having an OHV/AV (wherein AV is an acid value of the polyester resin and OHV is a hydroxyl value thereof) value of not lower than 1.2 are generally used. This is because toners obtained by using a polyester resin having an OHV/AV value of lower than 1.2 have a high fusing temperature and poor fluidity in comparison with toners obtained by using a polyester resin having an OHV/AV value of not lower than 1.2. Further, a large amount of a surface treating agent such as hydrophobic fine silica powder must be added to the toners to impart sufficient fluidity. Also, when the above-described fine polymer particles as the cleaning aid are added, fluidity is further lowered disadvantageously.

SUMMARY OF THE INVENTION

The present invention is intended to solve all of the above mentioned problems associated with prior arts.

An object of the present invention is to provide a developer composition for developing an electrostatic charge image, containing a polyester resin as a binder resin, which cause no lowering in the fluidity of the toners and neither the reversing and breakage of the cleaning blade nor the occurrence of filming even when visible images are repeatedly formed over a long period of time.

With the view of solving the problems as mentioned above, the present inventors have made studies and found that when fine polymer particles having a glass transition temperature of not lower than 90° C. are deposited on the surface of the toner, an excellent developer composition can be obtained without the occurrences of the reversing and breakage of the cleaning blade even when visible images are repeatedly formed over a long period of time. The present inventors have made further studies on the basis of this finding and accomplished this invention.

Accordingly, the present invention provides a developer composition for an electrostatic charge image, which comprises a toner comprising a binder resin and a coloring agent, and 0.1 to 1.0% by weight of fine polymer particles with a glass transition temperature of 90° C. or higher deposited on the surface of the toner, the binder resin comprising, as a main component, a polyester resin with an OHV/AV value of 1.2 or more wherein OHV and AV represent the hydroxyl value and acid value of the polyester resin, respectively.

DETAILED DESCRIPTION OF THE INVENTION

Resins which constitute the fine polymer particles in the present invention include acrylic polymers, vinyl polymers and copolymers thereof. Examples of comonomers which can be used in the preparation of the mono- or copolymers include acrylic monomers such as acrylic acid, methyl acrylate, ethyl acrylate, n-butyl acrylate, isobutyl acrylate, n-octyl acrylate, 2-ethylhexyl acrylate, dodecyl acrylate, cyclohexyl acrylate, phenyl acrylate, acrylamide, acrylonitrile, methacrylic acid, methyl methacrylate, ethyl methacrylate, n-butyl methacrylate, isobutyl methacrylate, n-octyl methacrylate, 2-ethylhexyl methacrylate, dodecyl methacrylate, cyclohexyl methacrylate and phenyl methacrylate; and vinyl monomers such as styrene monomers, for example, styrene, α-methylstyrene, o-methylstyrene, p-methylstyrene, p-methoxystyrene and p-chlorostyrene, carboxylic acids having an unsaturated double bond, for example, maleic acid, fumaric acid and itaconic acid and alkyl esters thereof, and olefin monomers, for example, ethylene, propylene and butadiene.

In the case of the above copolymer being used, there is no particular limitation with regard to the combination of monomers, including a methyl methacrylate-styrene copolymer, a methyl acrylate-styrene copolymer and a methyl methacrylate-α-methylstyrene copolymer, preferably a methyl methacrylate-styrene copolymer.

The fine polymer particles to be used in the present invention can be prepared by polymerizing the above monomers with any conventional method such as suspension polymerization, emulsion polymerization, soap-free polymerization and dispersion polymerization.

The fine polymer particles in the present invention have an average particle size generally of 0.05 to 1.0 μm, preferably 0.1 to 0.5 μm. When the fine polymer particles have an average particle size smaller than 0.05 μm, it is unexpectedly observed that the fine polymer particles have an effect of solving the problems with regard to the reversing and breakage of the cleaning blade even when the fine polymer particles are deposited on the surface of the toner. When the average particle size is larger than 1.0 μm, the fluidity of the toner is lowered and the feedability of the toner from a toner feeder (a hopper) to the developing apparatus is greatly reduced.

The term "average particle size" of the fine polymer particles as used herein refers to a mean value of particle sizes calculated from the number average particle size. For example, the average particle size can be evaluated by measuring particle sizes according to the dynamic light scattering method with coultar counter N-4 (manufactured by Nikkaki KK). The particle size distribution of the fine polymer particles may be a monodisperse system, a nearly monodisperse system or a polydisperse system without particular limitation.

The fine polymer particles in the present invention have a glass transition temperature of usually not lower than 90° C., preferably not lower than 100° C. The upper limit of the glass transition temperature of the fine polymer particles is not particularly restricted, but is substantially about 110° C. When the glass transition temperature is lower than 90° C., toner grains fuse together on the surface of the photo conductor by the pressure of the cleaning blade or by the frictional heat between the surface of the photo conductor and the cleaning blade.

In the developer composition for developing an electrostatic charge image according to the present invention, the amount of the fine polymer particles to be deposited on the surface of the toner is usually 0.01 to 1.0% by weight, preferably 0.05 to 0.3% by weight, based on the weight of the toner. When the amount of the fine polymer particles is smaller than 0.01% by weight, it is unexpectedly observed that the fine polymer particles have an effect of solving the problems with regard to the reversing and breakage of the cleaning blade, while when the amount is greater than 1.0% by weight, a lowering in charge stability is caused by free fine particles.

The polyester resins used as the principal component of the binder resin in the present invention can be obtained by a polycondensation reaction between an alcohol and a carboxylic acid or an ester or anhydride thereof. For example, the polyester resins can be prepared by carrying out the polycondensation reaction at a temperature of 180° to 250° C. in an inert gas atmosphere. The reaction can be carried out in the presence of conventional esterification catalyst such as zinc oxide, stannous oxide, dibutyltin oxide or dibutyltin dilaurate to accelerate the reaction. The reaction can be carried out under reduced pressure, if desired.

Specific examples of the thus-prepared polyester resins include the following resins.

Polyester Resin (1)

Polyester resins containing at least 3.0% by weight of ethyl acetate-insoluble matters (see, JP-A-62-195676).

Polyester Resin (2)

Polyester resins obtained by copolycondensating (a) a diol component, (b) a dicarboxylic acid or an anhydride or lower alkyl ester thereof and (c) a tri- or polycarboxylic acid or an anhydride or lower alkyl ester thereof, or a trihydric or polyhydric alcohol (see, JP-A-62-195677).

Polyester Resin (3)

Polyester resins obtained by copolycondensating (a) a diol component, (b) a dicarboxylic acid containing 5 to 50 mol %, based on the amount of the total carboxylic acid component, of an alkyl- or alkenylsuccinic acid, or an anhydride or lower alkyl ester thereof and (c) a tri- or polycarboxylic acid or an anhydride or lower alkyl ester thereof, or a trihydric or polyhydric alcohol (see, JP-A-62-195678).

Polyester resin (4)

Polyester resins obtained by copolycondensating (a) a diol component, (b) a dicarboxylic acid containing 5 to 50 mol %, based on the amount of the total carboxylic acid component, of an alkyl- or alkenylsuccinic acid, or an anhydride or lower alkyl ester thereof and (c) a tri- or polycarboxylic acid containing 0.1 to 20 mol %, based on the amount of the total carboxylic acid component, of a tetracarboxylic acid represented by Formula (II):

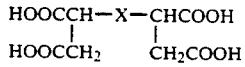

(II)

(wherein X represents an alkylene or alkenylene group having 5 to 30 carbon atoms and at least one side chain having not less than 3 carbon atoms) or an anhydride or lower alkyl ester thereof, or an anhydride or lower alkyl ester of said tri- or polycarboxylic acid (see, JP-A-62-195679).

Polyester resin (5)

Polyester resin obtained by copolycondensing (a) a diol component, (b) a dicarboxylic acid or an anhydride or lower alkyl ester thereof, (c) a trihydric or polyhydric alcohol and (d) a tri- or polycarboxylic acid or an anhydride or lower alkyl ester thereof (see, JP-A-62-195680).

A diol component which can be used in the present invention as the alcohol component may be represented by Formula (I):

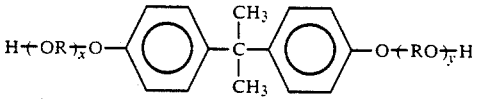

(I)

wherein R represents an ethylene group or a propylene group; and x and y each represents an integer of 1 to 10. In the mixture of compounds represented by Formula (I), the mean value of x+y may be 2 to 7.

Examples of the diol component represented by Formula (I) include polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)polyoxyethylene(2.0)-2,2-bis(4-hydroxyphenyl)propane and polyoxypropylene(6)-2,2-bis(4-hydroxyphenyl)propane, preferably polyoxypropylene(2.2)-2,2-bis(4-hydroxyphenyl)propane and polyoxyethylene(2.0)-2,2-bis(4-hydroxyphenyl)propane.

Alternatively, other diols such as ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, bisphenol A and hydrogenated bisphenol A may be used.

Examples of trihydric and polyhydric alcohols which can be used in the present invention include sorbitol, 1,2,3,6-hexanetetrol, 1,4-sorbitan, pentaerythritol, dipentaerythritol, tripentaerythyritol, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxybenzene.

Examples of dicarboxylic acids which can be used include maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid and alkyl- or alkenylsuccinic acids such as n-butylsuccinic acid, n-butenylsuccinic acid, isobutylsuccinic acid, isobutenylsuccinic acid, n-octylsuccinic acid, n-octenylsuccicic acid, n-dodecylsuccinic acid, n-dodecenylsuccinic acid, isododecylsuccinic acid and isododecenylsuccinic acid. Further, the anhydrides and lower alkyl esters of these carboxylic acids can be used.

Examples of tricarboxylic acids and polycarboxylic acids which can be used in the present invention include 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl)methane, 1,2,7,8-octanetetracarboxylic acid, empole trimer acid, and the anhydrides and lower alkyl esters thereof.

Specific examples of the tetracarboxylic acids represented by Formula (II) include the following compounds (1) to (12).

(1) 4-Neopentylidenyl-1,2,6,7-heptanetetracarboxylic acid
(2) 4-Neopentyl-1,2,6,7-heptene(4)-tetracarboxylic acid
(3) 3-Methyl-4-heptenyl-1,2,5,6-hexanetetracarboxylic acid
(4) 3-Methyl-3-heptyl-5-methyl-1,2,6,7-heptene(4)-tetracarboxylic acid
(5) 3-Nonyl-4-methylidenyl-1,2,5,6-hexanetetracarboxylic acid
(6) 3-Decylidenyl-1,2,5,6-hexanetetracarboxylic acid
(7) 3-Nonyl-1,2,6,7-heptene(4) tetracarboxylic acid
(8) 3-Decenyl-1,2,5,6-hexanetetracarboxylic acid
(9) 3-Butyl-3-ethylenyl-1,2,5,6-hexanetetracarboxylic acid
(10) 3-Methyl-4-butylidenyl-1,2,6,7-heptanetetracarboxylic acid
(11) 3-Methyl-4-butyl-1,2,6,7-heptane(4)-tetracarboxylic acid
(12) 3Methyl-5-octyl-1,2,6,7-heptene(4)-tetracarboxylic acid Generally, the frictionally charged amount of polyester resin itself is changed according to the amount of terminal groups, which were carboxyl groups and/or hydroxyl groups remaining at the terminals of the molecule, unless an ester exchange reaction or a reaction with a monocarboxylic acid and/or a monohydric alcohol takes place. Namely, when the acid value in terms of the terminal group is excessively increased, the frictional charged amount of polyester resin is lowered. On the other hand, when the acid value is excessively increased, the frictional charged amount of polyester resin is increased to a certain degree, but environment dependence after toner formation becomes remarkable and it is hard to use the polyester resin in the developer composition. For this reason, polyester resins having an acid value of 5 to 60 (KOH mg/g) are generally used for toners. Further, toners comprising a polyester resin having an OHV/AV (wherein AV is an acid value and OHV is a hydroxyl value) value of not lower than 1.2, preferably 1.2 to 100, more preferably 1.2 to 30, have good fluidity, and the minimum fusing temperature can be lowered by the use of the toners, though the exact reason for these advantageous results so far are not known.

The polyester resins which can be used in the present invention include the above-described polyester resins (1) to (5) wherein an OHV/AV value is not lower than 1.2 for the above-described reason. AV and OHV are measured according to JIS-K0070 (Japanese Industrial Standard). Dioxane is preferably used as the solvent for measuring the acid value in terms of Polyester Resin (1).

The polyester resins having an OHV/AV value of not lower than 1.2 can be readily obtained by using a greater amount of the whole alcohol component rather than that of the whole carboxylic acid component in terms of the number of functional groups in the copolycondensation reaction (see, JP-A-62-195677, JP-A-62-195678, JP-A-63-68849, JP-A-63-68850, JP-A-63-163469 and JP-A-1-155362).

If desired, not more than 30% by weight of other resins, such as styrene resins or styrene-acrylic resins having a number-average molecular weight of not more than 11,000, may be used in the binder resin to improve crushability in the formation of the toner. Generally, a characteristic improver such as wax as anti-offset agent is added during the preparation of toner. However, when the polyester resins in the present invention are used as the binder resin, the characteristic improver does not have to be used or can be used in a small amount.

Coloring agents which can be used in the developer composition of the present invention include conventional inorganic pigments such as carbon black and iron black, conventional chromatic dyes and conventional organic pigments.

The toner to be used in the present invention can be obtained from the above binder resins and coloring agents by conventional manners. For example, a mixture of about 90 parts by weight of binder resin and about 3 to 10 parts by weight of coloring agent may be kneaded and crushed to obtain a toner having a particle size distribution of about 5 to 15 μm and an average particle size of about 10 μm.

If desired, charge control agents conventionally used in electrophotography may be contained in the toner in the present invention in an amount of 0.1 to 8.0% by weight, preferably 0.2 to 5.0% by weight, based on the amount of the binder resin.

Examples of charge control agents which are negatively chargeable, for negatively chargeable toners, include metal-containing azo dyes such as Varifast Black 3804, Bontron S-31, Bontron S-32, Bontron S-34 and Bontron S-36 (products of Orient Kagaku KK) and Aizen Spiron Black T-77 (a product of Hodogaya Chemical Co., Ltd.), copper phthalocyanine dye and metal complexes of the alkyl derivatives of salicylic acid such as Bontron E-82, Bontron E-84 and Bontron E-85 (products of Orient Kagaku KK).

Charge control agents which are positively chargeable can be used in combination with the charge control agents which are negatively chargeable. When the charge control agent which is positively chargeable is used in an amount of ½ or less of that of the charge control agent which is negatively chargeable, good visible images can be obtained without causing a lowering in the density thereof even when 50,000 or more copies are continuously made. Examples of charge control agents which are positively chargeable, for positively chargeable toners, include Nigrosine dyes such as Nigrosine Base EX, Oil Black BS, Oil Black SO, Bontron N-01 and Bontron N-11 (products of Orient Kagaku KK), triphenylmethane dyes having tertamine side chains, quaternary ammonium salt compounds such as Bontron P-51 (a product of Orient Kagaku KK) and cetyltrimethylammonium bromide and polyamine resins such as AFP-B (a product of Orient Kagaku KK).

If desired, the toner in the present invention may contain a magnetic powder of a material which can be magnetized when it is placed in a magnetic field, to be used as a magnetic toner. Examples of the magnetic powder include powders of ferromagnetic metals such as iron, cobalt and nickel and alloys and compounds thereof such as magnetite, hematite and ferrite. The magnetic powder may be used in an amount of 15 to 70% by weight based on the weight of the toner.

The developer composition for electrostatic charge image according to the present invention can be prepared, for example, by a method wherein the fine polymer particles are added to the toner in such an amount as to deposit a predetermined amount of the fine polymer particles on the toner followed by mixing in a mixer; or a wet mixing method wherein the toner is added to an emulsion containing the fine polymer particles followed by stirring, though there is no particular limitation. If desired, additives can be used during the preparation of the developer composition, such as fluidity improver (e.g., hydrophobic silica) and metal oxides.

The developer composition of the present invention may be optionally mixed with carrier particles to obtain a binary developer system, such as iron powder, glass beads, nickel powder or ferrite powder, in such an amount that the carrier particles comprise about 90 to 98% by weight of the developer system.

The developer composition of the present invention can be used in various development methods such as magnetic brush development, cascade development, development using electrically conductive magnetic toner, development using high-resistant magnetic toner, far brush development, powder cloud development and impression development.

The present invention is now illustrated in greater detail by reference to the following examples which, however, are not to be construed as limiting the present invention in any way. Unless otherwise indicated, all parts, percents, ratios and the like are by weight in the following examples.

SYNTHESIS EXAMPLE OF FINE PARTICLES OF ACRYLIC-VINYL POLYMERS

In a 1-liter separable flask equipped with a stirrer, a thermometer, a nitrogen gas introducing tube, a reflux condenser and dropping funnels were placed 300 parts of ion exchanged water, 0.5 part of sodium dodecylsulfate and 0.5 part of potassium persulfate as a polymerization initiator. Subsequently, 70 parts of methyl methacrylate and 30 parts of styrene were added dropwise thereto through the dropping funnels. After the completion of the dropwise addition, the mixture was kept at 80° C. for 3 hours to complete the polymerization reaction. The reaction mixture (solution) was dried by means of a spray dryer to obtain fine polymer particles having an average particle size of 0.1 μm and a glass transition temperature of 105° C. (which was referred to as Fine Particle-A).

Fine Particle-B having an average particle size of 0.3 μm and a glass transition temperature of 106° C. and Fine Particle-C having an average particle size of 0.1 μm and a glass transition temperature of 61° C. were prepared in the same manner as described above except that the amount of sodium dodecylsulfate was changed to 0.05 part and that butyl methacrylate was used in place of methyl methacrylate, respectively.

RESIN PREPARATION EXAMPLE 1

In a 3-liter four-necked glass flask were placed 714 g of polyoxypropylene(2.2)-2,2-bis(4-hydroxyphenyl)-propane, 663 g of polyoxyethylene(2.2)-2,2-bis(4-hydroxyphenyl)propane, 518 g of isophthalic acid, 70 g of isooctenylsuccinic acid, 80 g of 1,2,4-benzenetricarboxylic acid and 2 g of dibutyltin oxide. The flask was equipped with a thermometer, a stainless steel stirrer, a reflux condenser and a nitrogen gas introducing tube, and the mixture was reacted at 210° C. with stirring in a nitrogen gas stream in a mantle heater. The reaction was terminated when the softening point of the formed resin reached 130° C. while the degree of polymerization was determined from the softening point measured according to ASTM E28-51T. The resulting resin was a light yellow solid and had a glass transition point of 65° C. as measured with DSC (differential scanning calorimeter). The resin had an acid value of 18 KOH mg/g and a hydroxyl value of 35 KOH mg/g. The resin was used as Binder Resin (1) (OHV/AV =1.94).

RESIN PREPARATION EXAMPLE 2

The procedure of Resin Preparation Example 1 was repeated except that the amount of isophthalic acid was 710 g. There was obtained a polyester resin having a softening point of 130° C., a glass transition temperature of 69° C., an acid value of 30 KOH mg/g and a hydroxyl value of 19 KOH mg/g. The resin was used as Binder Resin (2) (OHV/AV=0.63).

Preparation of Toner

The following ingredients were thoroughly mixed in a Henschel mixer, kneaded in a twin-screw extruder, cooled, granulated, crushed in a jet mill and classified by an air classifier to obtain fine powders having an average particle size of 10 μm.

| | |
|---|---|
| Toner X | |
| Binder Resin (1) | 88 parts |
| Carbon Black (Legal 400R, manufactured by Cabot Inc.) | 8 parts |
| Negatively chargeable charge control agent (Aizen Spiron Black T-77, manufactured by Hodogaya Chemical Co., Ltd.) | 2 parts |
| Wax (Biscoal 550P, manufactured by Sanyo Chemical Industries, Ltd.) | 2 parts |
| Toner Y | |
| Binder Resin (2) | 88 parts |
| Carbon Black (Legal 400 R, manufactured by Cabot Inc.) | 8 parts |
| Negatively chargeable charge control agent (Aizen Spiron Black T-77, manufactured by Hodogaya Chemical Co., Ltd.) | 2 parts |
| Wax (Biscoal 550P, manufactured by Sanyo Chemical Industries, Ltd.) | 2 parts |

EXAMPLE 1

3 g of hydrophobic silica (Aerosil R-972, manufactured by Nippon Aerosil KK) and 1 g of Fine Particle-A prepared above were mixed with 1,000 g of Toner X prepared above in a Henschel mixer to thereby deposit them on the toner, thus obtaining Composition 1.

EXAMPLE 2

3 g of hydrophobic silica (Aerosil R-972) and 4 g of Fine Particle-A were mixed with 1,000 g of Toner X in a Henschel mixer to thereby deposit them on the toner, thus obtaining Composition 2.

EXAMPLE 3

3 g of hydrophobic silica (Aerosil R-972) and 7 g of Fine Particle-A were mixed with 1,000 g of Toner X in a Henschel mixer to thereby deposit them on the toner, thus obtaining Composition 3.

EXAMPLE 4

3 g of hydrophobic silica (Aerosil R-972) and 4 g of Fine Particle-B were mixed with 1,000 g of Toner X in a Henschel mixer to thereby deposit them on the toner, thus obtaining Composition 4.

COMPARATIVE EXAMPLE 1

3 g of hydrophobic silica (Aerosil R-972) was mixed with 1,000 g of Toner X in a Henschel mixer to thereby deposit silica on the toner, thus obtaining Comparative Composition 1.

COMPARATIVE EXAMPLE 2

3 g of hydrophobic silica (Aerosil R-972) and 12 g of Fine Particle-A were mixed with 1,000 g of Toner X in a Henschel mixer to thereby deposit them on the toner, thus obtaining Comparative Composition 2.

COMPARATIVE EXAMPLE 3

3 g of hydrophobic silica (Aerosil R-972) and 4 g of Fine Particle-C were mixed with 1,000 g of Toner X in a Henschel mixer to thereby deposit them on the toner, thus obtaining Comparative Composition 3.

COMPARATIVE EXAMPLE 4

3 g of hydrophobic silica (Aerosil R-972) and 1 g of Fine Particle-A were mixed with 1,000 g of Toner Y in a Henschel mixer to thereby deposit them on the toner, thus obtaining Comparative Composition 4.

The above compositions were examined with respect to the fluidity and the reversing and breakage of the blade as well as to the filming when practically used in a copying press.

The fluidity of the composition was measured in the manner described below. More specifically, the testing device was a fluidity evaluation device wherein a screw revolving at a speed of 10 rpm and a buffer part were provided within a conical hopper. The measurement was made in such a manner that 300 g of a composition to be measured was put into a 1-liter polyethylene container, the container was intensively shaken up and down and transferred into the hopper, a motor was driven for 5 minutes, the amount of the composition dropped per minute was determined from the weight of the composition dropped onto a receiver, and the amount was referred to as composition drop amount (g/min).

A developer obtained by mixing the composition with a spherical ferrite carrier, having a particle size of 100 to 200 mesh in a ratio of the composition to the carrier of 5:95 by weight, was used in a copying press provided with a selenium photo conductor, and 50,000 copies were continuously made under normal environmental conditions (24° C., 50% RH). A comparison between the compositions, with respect to the reversing and breakage of the blade during the course of a printing durability test, was made. The evaluation of the reversing and breakage of the blade and filming was visually made. The results are shown in Table 1.

TABLE 1

| Composition | Resin | Fine Polymer Particles Type | Tg (°C.) | Average Particle Size μm) | Amount Added (wt %) | Fluidity of Toner (g/min) | Reversing and Breakage of Blade | Filming |
|---|---|---|---|---|---|---|---|---|
| Composition | | | | | | | | |
| 1 | X | A | 105 | 0.1 | 0.1 | 7.9 | none | none |
| 2 | X | A | 105 | 0.1 | 0.4 | 7.5 | none | none |
| 3 | X | A | 105 | 0.1 | 0.7 | 7.2 | none | none |
| 4 | X | B | 106 | 0.3 | 0.4 | 7.4 | none | none |
| Comparative Composition | | | | | | | | |
| 1 | X | — | — | — | — | 8.1 | Reversed after 2,000 copies | none |
| 2 | X | A | 105 | 0.1 | 1.2 | 5.8 | none | Occurred after 3,000 copies |
| 3 | X | C | 61 | 0.1 | 0.4 | 7.5 | none | Occurred after 1,000 copies |
| 4 | Y | A | 105 | 0.1 | 0.1 | 5.7 | none | none |

It is apparent from Table 1 that when the fine polymer particles in the present invention are added to the toner, the reversing and breakage of the cleaning blade can be prevented from occurring. On the other hand, when Comparative Composition 1, wherein the fine polymer particles are not added to a toner, is used, the reversing of cleaning blade occurs, and when the fine polymer particles having a low glass transition temperature are added, filming on the photo conductor occurs as shown in Comparative Example 3. Further, when the amount of the fine polymer particles added is more than 1.0% by weight, there are caused disadvantages that fluidity is greatly lowered and filming occurs as shown in Comparative Example 2. When the OHV/AV value is lower than the specified value, fluidity is poor, as shown in Comparative Example 4, and it is impossible to add the fine polymer particles.

It will be understood from the above disclosure that when the fine polymer particles in the present invention are added to the toner comprising the polyester resin having an OHV/AV value of 1.2 or higher as the principal component, fluidity can be improved and the problems in regard to the filming of the fine polymer particles and the reversing and breakage of the blade can be solved, unlike the use of conventional fine particles of acrylic polymers and the metal salts of fatty acids.

While the invention has been described in detail and with reference to specific embodiments thereof, it will be apparent to one skilled in the art that various changes and modifications can be made therein without departing from the spirit and scope thereof.

What is claimed is:

1. A developer composition for an electrostatic charge image, which comprises a toner comprising a binder resin and a coloring agent, and 0.1 to 1.0% by weight of fine polymer particles with a glass transition temperature of 90° C. or higher deposited on the surface of said toner, said binder resin comprising, as a main component, a polyester resin with an OHV/AV value of 1.2 or more wherein OHV and AV represent the hydroxyl value and acid value of said polyester resin, respectively.

2. A composition as in claim 1, wherein said fine polymer particles are particles of at least one polymer selected from the group consisting of a acrylic polymer, a vinyl polymer and an acrylic-vinyl copolymer.

3. A composition as in claim 2, wherein said polymer is an acrylic-vinyl copolymer.

4. A composition as in claim 3, wherein said copolymer is a methyl methacrylate-styrene copolymer.

5. A composition as in claim 1, wherein said fine polymer particles have an average particle size of 0.05 to 1.0 μm.

6. A composition as in claim 5, wherein said average particle size of the fine polymer particles is 0.1 to 0.5 μm.

7. A composition as in claim 1, wherein said glass transition temperature of the fine polymer particles is 100° C. or higher.

8. A composition as in claim 1, wherein the amount of the fine polymer particles deposited on the surface of the toner is 0.05 to 0.30% by weight.

* * * * *